US010390631B2

(12) United States Patent
Smith

(10) Patent No.: US 10,390,631 B2
(45) Date of Patent: Aug. 27, 2019

(54) SKEWER FOR LOADING CUTLERY

(71) Applicant: JADE GROUP INTERNATIONAL LLC, West Bend, WI (US)

(72) Inventor: Patrick J. Smith, West Bend, WI (US)

(73) Assignee: JADE GROUP INTERNATIONAL LLC, West Bend, WI (US)

( * ) Notice: Subject to any disclaimer, the term of this patent is extended or adjusted under 35 U.S.C. 154(b) by 0 days.

(21) Appl. No.: 16/075,734

(22) PCT Filed: Feb. 10, 2017

(86) PCT No.: PCT/US2017/017296

§ 371 (c)(1),
(2) Date: Aug. 6, 2018

(87) PCT Pub. No.: WO2017/139527

PCT Pub. Date: Aug. 17, 2017

(65) Prior Publication Data

US 2019/0029443 A1 Jan. 31, 2019

Related U.S. Application Data

(60) Provisional application No. 62/293,377, filed on Feb. 10, 2016.

(51) Int. Cl.
*A47F 1/10* (2006.01)
*A47F 1/08* (2006.01)

(52) U.S. Cl.
CPC ..... *A47F 1/10* (2013.01); *A47F 1/08* (2013.01); *A47F 2001/103* (2013.01)

(58) Field of Classification Search
CPC ..... A47F 1/00; A47F 1/04; A47F 1/08; A47F 1/10; A47F 2001/103; A47F 13/08; A47F 7/0007; A47F 7/0014; A47F 7/281; A47F 7/0035; A47F 7/0064; A47G 21/00; A47G 21/02; A47G 21/04; A47G 21/06; A47G 21/14; A47G 29/087; B65D 83/00; B65D 83/08; B65D 85/20; B65D 7/10;
(Continued)

(56) References Cited

U.S. PATENT DOCUMENTS 531,496 A * 12/1894 Barwick ..... B42D 5/005 281/19.1
719,208 A * 1/1903 Garda ..... B26B 11/00 30/143

(Continued)

FOREIGN PATENT DOCUMENTS

EP 1217923 B1 9/2003
EP 1213985 B1 6/2004

*Primary Examiner* — Jennifer E. Novosad
(74) *Attorney, Agent, or Firm* — Shane Cortesi

(57) ABSTRACT

A skewer for loading stacks of plastic cutlery into dispensers. The skewer includes a vertical shaft that protrudes through holes in the stacked cutlery pieces and a front tab that may be removably attached to the vertical shaft. In some embodiments, the front tab is rotatable relative to the vertical shaft. The front tab may have a locked position in which the front tab is fixed to the vertical shaft and extends along the height of the stack and an unlocked position in which the front tab is disengaged from the vertical shaft and rotates forwardly relative to the stack and the vertical shaft to allow the user to remove the skewer after loading the stack into a dispenser.

9 Claims, 4 Drawing Sheets

(58) Field of Classification Search
CPC . A47B 77/14; A47J 45/02; A47J 45/00; B42F 13/12; B42F 13/14
USPC ..... 211/70.7, 59.4, 125, 49.1, 50, 54.1, 196, 211/205, 133.4, 107–112, 7; 30/142, 322, 30/324, 326, 323, 327; 206/553, 499; 221/1, 195, 197, 312 A; 312/42, 43, 45, 312/50, 59, 60, 61, 71, 72, 35; D7/643, D7/683, 686
See application file for complete search history.

(56) References Cited

U.S. PATENT DOCUMENTS 1,090,554 A * 3/1914 McCornack ..... A47F 5/0823 211/57.1
1,213,985 A * 1/1917 Welsh ..... A41C 1/14 2/259
1,282,875 A * 10/1918 Kupec ..... B26B 11/00 30/143
2,172,013 A * 9/1939 Parry ..... A47G 19/265 211/59.4
2,237,378 A * 4/1941 Thienemann ..... H04L 43/50 33/501
2,439,882 A * 4/1948 Beddow ..... A47G 21/06 30/147
2,744,530 A * 5/1956 Swenson ..... B42F 13/14 402/20
3,533,511 A * 10/1970 Giampa ..... B42F 13/12 211/125
3,788,487 A * 1/1974 Dawson ..... A47F 1/065 206/499
4,043,203 A * 8/1977 Montesi ..... G01F 19/002 73/427
4,254,879 A * 3/1981 Maule ..... A47F 7/024 211/4
4,257,715 A * 3/1981 Ferrero ..... B42F 13/14 402/47
4,462,497 A * 7/1984 Maule ..... A47F 5/04 211/59.1
4,474,300 A * 10/1984 Entis ..... A47F 5/0861 211/4
4,491,446 A * 1/1985 Ewald ..... B64G 1/222 410/32
4,539,749 A * 9/1985 Hyeong-Woon ..... A47G 21/06 30/147
4,789,064 A * 12/1988 Segal ..... A47G 21/02 206/478
5,284,258 A * 2/1994 Genero ..... F16B 2/205 211/46
5,667,323 A * 9/1997 Whaley ..... B42F 13/14 402/26
5,845,403 A * 12/1998 Nivin ..... A47G 21/06 30/147
5,921,408 A * 7/1999 Groenewold ..... A47F 1/06 206/497
6,336,568 B1 * 1/2002 Tucker ..... A47F 1/10 221/131
7,775,362 B2 * 8/2010 Yoshizawa ..... H01L 21/6734 206/386
8,152,004 B2 * 4/2012 Smith ..... A47F 1/10 211/70.7
8,210,364 B2 * 7/2012 Smith ..... A47F 1/10 211/70.7
8,272,533 B1 * 9/2012 D'Amelia ..... A47F 1/10 221/172
8,776,379 B2 * 7/2014 Walters ..... A47G 21/06 30/142
9,560,920 B2 * 2/2017 Oakes ..... A47F 1/125
9,693,640 B2 * 7/2017 Oakes ..... A47F 1/126
9,924,816 B2 * 3/2018 Oakes ..... A47G 21/06
9,986,794 B2 * 6/2018 Greenspoon ..... A44B 17/00
2004/0052572 A1 * 3/2004 Peters ..... B42F 13/14 402/60

* cited by examiner

SKEWER FOR LOADING CUTLERY

TECHNICAL FIELD

The present disclosure relates to plastic cutlery dispensers accessories, more particularly, to skewers for loading stacks of cutlery pieces into plastic cutlery dispensers.

BACKGROUND OF THE INVENTION

Dispensers of plastic cutlery pieces (e.g., knives, spoons, forks and sporks) are well known in the art. U.S. Pat. No. 6,336,568 to Tucker, the entire contents of which are incorporated herein by reference, relates to a cartridge-type dispenser that dispenses cutlery pieces one at a time upon hand operation of an externally accessible utensil delivery controller. The dispenser includes a housing having at least one interior compartment in communication with an exit opening. At least partially accommodateable within the interior compartment is a stack of cutlery within a cartridge capable of universally accommodating knives or forks or spoons and provided with a portal through which a single piece of cutlery can pass and wherein a dispensable piece of cutlery is situated. The portal is situated in a pathway aligned with the exit opening. Finally, the utensil delivery controller is an externally accessible hand operable ejector engageable with the cutlery and situated for ejecting the cutlery from the portal of the cartridge and thereafter through the pathway to the exit opening for ultimate user retrieval.

Other types of dispensers include dispensers in which the cutlery is loaded in the housing such as U.S. Pat. No. 8,210,364 to Smith, the entire contents of which are incorporated herein by reference. In U.S. Pat. No. 8,210,364 the dispenser generally includes a housing comprising: (a) an actuator, the actuator generally facing in a direction associated with a side of the housing; (b) an opening for loading disposable cutlery; (c) a dispensing chute through which the cutlery passes prior to ejection from the housing; and (d) at least one rocking cam comprising a displacement surface and having a first position and a second position, wherein upon activation of the actuator, the rocking cam moves from the first position to the second position and the displacement surface contacts at least one piece of cutlery, moving the at least one piece of cutlery in a generally lateral direction and toward the dispensing chute, wherein the generally lateral direction is towards the side of the housing in which the actuator is generally facing.

Certain dispensers require reloading the dispensers once all the cutlery is used. Such reloading takes time and, if incorrectly loaded, the dispenser could be prone to jamming. Also, if the person loading the dispenser has not washed her hands prior to loading, the utensils may be unhygienic.

U.S. Pat. No. 8,152,004 to Smith describes a banded packets of disposable cutlery that uses an adhesive.

European Patent No. 1,213,985 to Cassebasse teaches a rod that has one end a grip part and a retaining abutment that holds the top spoon in a stack of spoons in place and at the other end a retaining abutment which holds the bottom spoon in place and the rod is extracted by elastically retracting the elastic retaining projection as the first step in the extraction operation. The rod is inserted through a hole in the stack of spoons. The system described in European Patent No. 1,213,985 is disadvantageous because it requires a large slot in the cutlery pieces.

Thus, there is a continuing need for new methods of loading cutlery into dispensers.

BRIEF SUMMARY

A skewer system for loading a stack of cutlery into a cutlery dispenser is described herein.

Optionally, the system includes: a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side, a rear side, a width extending from the front side to the rear side and generally parallel to the stack width, an eating portion, a handle extending from the eating portion, the handle comprising a handle end and a hole extending from the cutlery piece top to the cutlery piece bottom; b) a skewer removably attached to the stack and comprising: i) a vertical shaft comprising a vertical shaft top, a vertical shaft bottom, and a vertical shaft height extending from the vertical shaft top to the vertical shaft bottom and generally parallel to the stack height, the vertical shaft positioned through the holes in the cutlery pieces; and ii) a front tab having a front tab top located above the top of the stack, a front tab bottom located below the bottom of the stack, and a height extending from the front tab top to the front bottom, the front tab configured to pivot between a locked position in which the front tab height is oriented generally parallel to the shaft height and an unlocked position in which the front tab height is not parallel (e.g., between about 10 and 180 degrees, preferably 30 to 180 degrees) to the shaft height.

Optionally, the front tab, in the locked position, comprises a front tab bar comprising a front tab bar top located above the top of the stack, a front tab bar bottom located below the bottom of the stack, and a front tab bar height extending from the front tab bar top to the front tab bar bottom, the front tab bar height generally parallel to the vertical shaft height and the stack height, the front tab bar extending along the stack height and confronting the front sides of the cutlery pieces as the front tab bar extends along the stack height, a top lateral extension that extends from the front tab bar generally perpendicular to the front tab bar height and is located directly above the top of the stack, the top lateral extension comprising a rear end connected to the vertical shaft top and a forward end, and a bottom lateral extension that extends from the front tab bar generally perpendicular to the front tab bar height and is located directly below the bottom of the stack. Optionally, the bottom lateral extension further comprises a fastener configured to removably engage the vertical shaft when the front tab is in the locked position. Optionally, the top lateral extension is attached to the vertical shaft top along a first pivot axis. Optionally, the system includes a recess located opposite (i.e., directly below) the first pivot axis and facing the top of the stack. Optionally, the system further includes a handle tab comprising a base connected to the shaft top end, an apex opposite the base, and a handle tab height extending from the base to the apex. Optionally, the handle tab base is connected to the shaft top end along a handle pivot axis and further wherein the handle tab is configured to pivot along the handle pivot axis between a downward position in which the apex is below the top of the stack and confronts the rear side of the stack and the handle tab height is generally parallel to the stack height to an upper position in which the apex is above the top of the stack. Optionally, the handle includes an aperture.

BRIEF DESCRIPTION OF THE DRAWINGS

in FIG. 1, the front tab is in the locked position.

in FIG. 2, the front tab is in the locked position.

in FIG. 3, the front tab is in the locked position.

in FIG. 4, the front tab is in the locked position.

in FIG. 5, the front tab is in the locked position.

in FIG. 6, the front tab is in the locked position.

in FIG. 7, the front tab is in the unlocked position.

in FIG. 9, the front tab is in the unlocked position.

in FIG. 10, the front tab is in the unlocked position.

in FIG. 11, the front tab is in the unlocked position.

in FIG. 12, the front tab is in the unlocked position.

in FIG. 13, the front tab is in the unlocked position.

DETAILED DESCRIPTION

Figure 1:
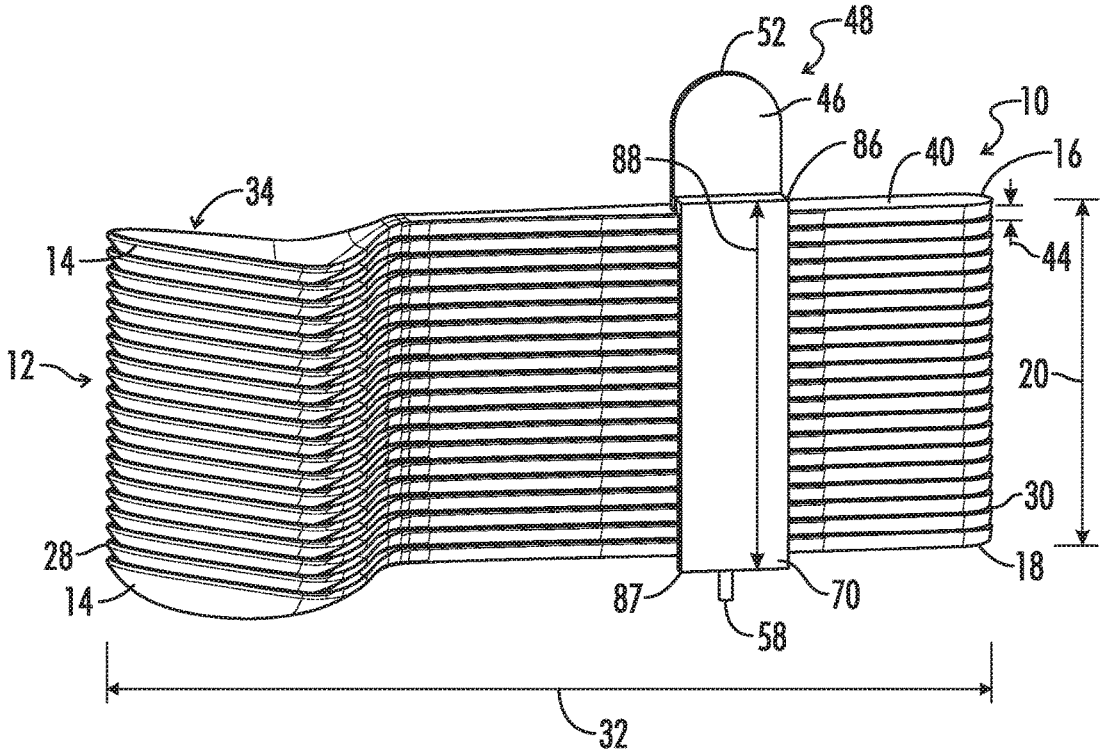
FIG. 1 illustrates a front elevation of one embodiment of the skewer system of the present invention.

Referring to FIGS. 1-13, the present disclosure provides a skewer system generally designated by the numeral 10. In the drawings, not all reference numbers are included in each drawing for the sake of clarity.

Figure 8:
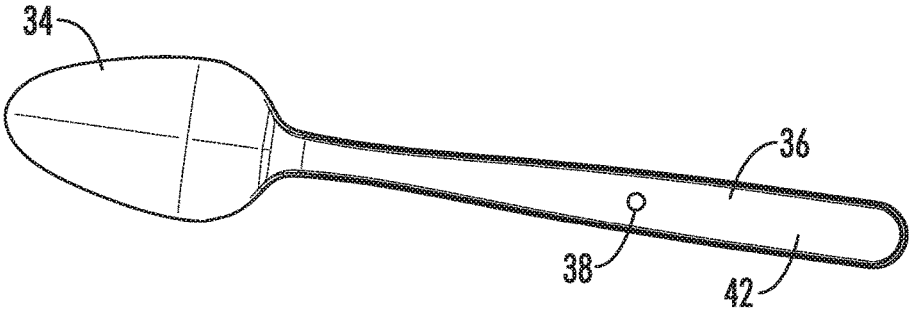
FIG. 8 illustrates a bottom perspective view of the stack of cutlery pieces of FIG. 1 without the skewer.
Figure 9:
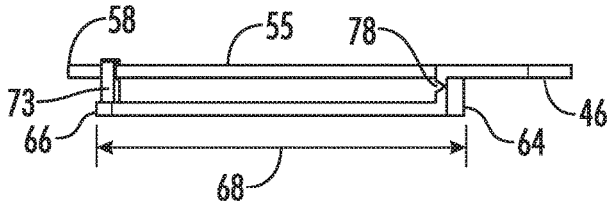
FIG. 9 illustrates a left side elevation view of the skewer of FIG. 6.
Figure 10:
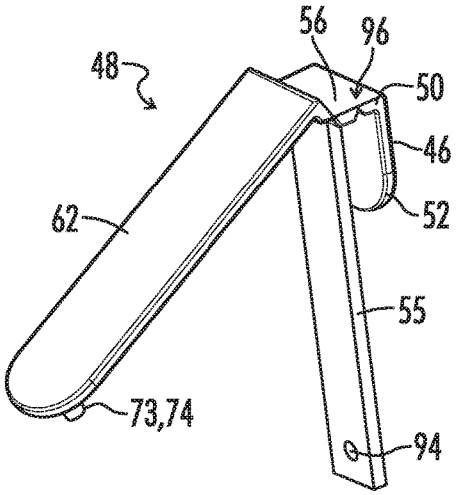
FIG. 10 illustrates a left side perspective of a skewer of another embodiment of the present invention.
Figure 11:
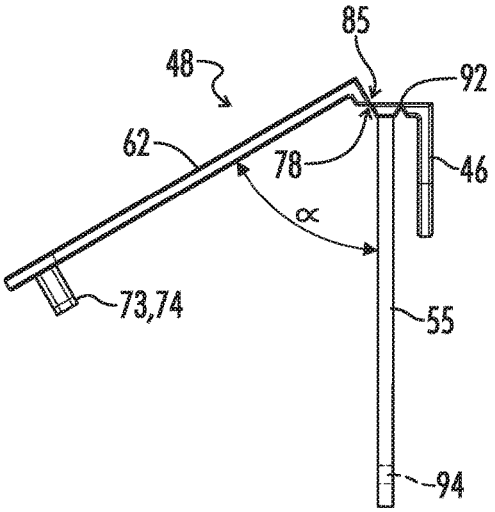
FIG. 11 illustrates a left side elevation view of the skewer of FIG. 10.
Figure 12:
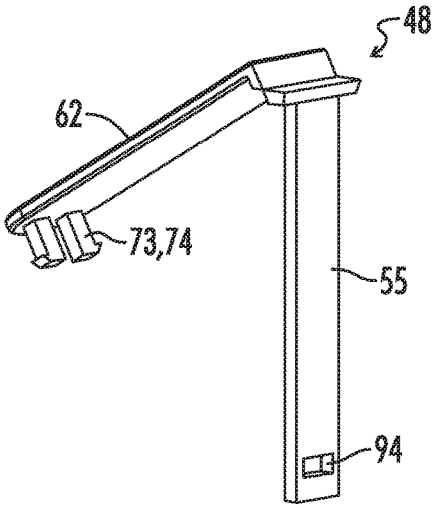
FIG. 12 illustrates a left side perspective of a skewer of another embodiment of the present invention.
Figure 13:
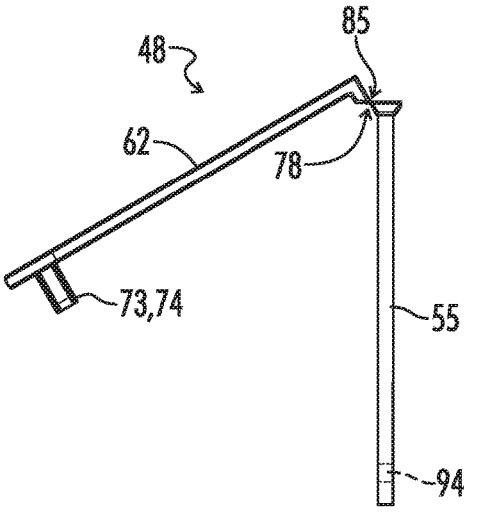
FIG. 13 illustrates a left side elevation view of the skewer of FIG. 12.

Referring to FIGS. 1-13, the skewer system 10 includes a stack 12 of pieces of cutlery 14. The stack 12 has a top 16, a bottom 18, a height 20 extending from the top 16 to the bottom 18, a front side 22, a rear side 24, a width 26 extending from the front side 22 to the rear side 24 and generally perpendicular to the height 20, a left side 28, a right side 30, and a length 32 extending from the left side 28 to the right side 30 and generally perpendicular to the width 26 and the height 20. Each piece of cutlery 14 has a top 40, a bottom 42, a height 44 extending from the top 40 to the bottom 42 and generally parallel to the stack height 20, a front side 80, a rear side 82, a width 84 extending from the front side 80 to the rear side 82 and generally parallel to the stack width 26, an eating portion 34 and a handle 36 extending from the eating portion 34 and comprising a handle tip 86. Each piece of cutlery 14 further has a hole 38 extending from the cutlery piece top 40 to the cutlery piece bottom 42. Preferably, the holes 38 in each piece of cutlery 14 are aligned, as shown in FIG. 8. Optionally, the holes 38 in each cutlery piece 14 are generally circular in shape and have a diameter of between about 2 and 6 millimeters. (The eating portion 34 is also referred to in the art as the food contact portion of the cutlery such as the serrations of a knife, the tines of a fork, and the bowl of a spoon).

The skewer system 10 further includes a skewer 48 removably attached to the stack 12 and comprising a vertical shaft 55 and a front tab 62 attached to, and preferably rotatable relative to, the vertical shaft 55.

The vertical shaft 55 has a vertical shaft top 56, a vertical shaft bottom 58, and a vertical shaft height 60 extending from the vertical shaft top 56 to the vertical shaft bottom 58. The vertical shaft 55 passes through the holes 38 in the cutlery pieces, and the vertical shaft height 60 is generally parallel to the stack height 20. The vertical shaft 55 may be for example cylindrical in shape and have a diameter that is slightly smaller (e.g., from about 0.0001 to about 0.25 inches smaller) than the diameter of the holes 38. Other shapes of the vertical shaft 55 and holes 38 are possible, for example, both may be shaped in the shape of a star.

Figure 2:
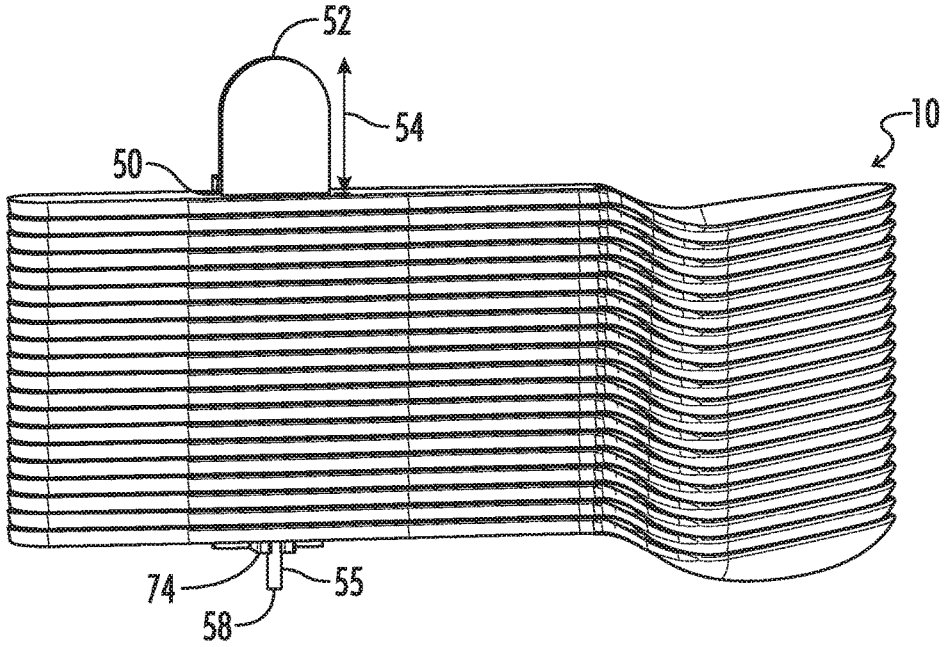
FIG. 2 illustrates a rear elevation of the skewer system of FIG. 1.
Figure 3:
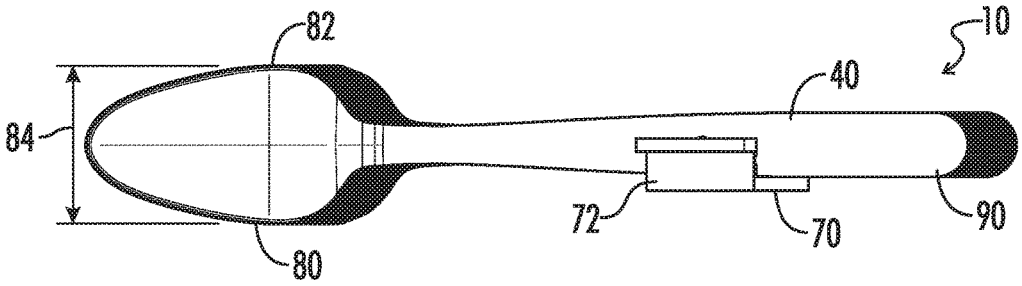
FIG. 3 illustrates a top, perspective view of the skewer system of FIG. 1.
Figure 4:
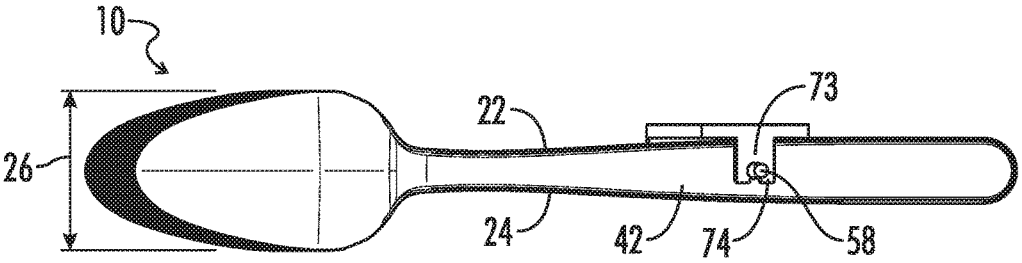
FIG. 4 illustrates a bottom, perspective view of the skewer system of FIG. 1.
Figure 5:
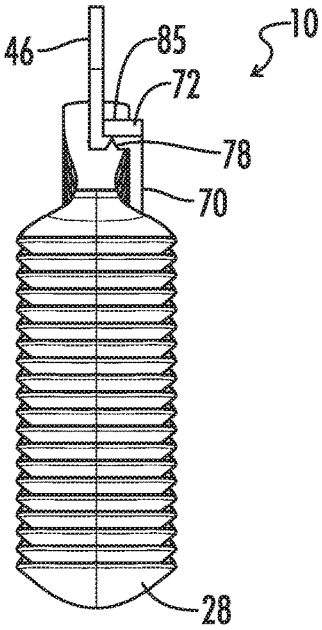
FIG. 5 illustrates a left side elevation view of the skewer system of FIG. 1.
Figure 6:
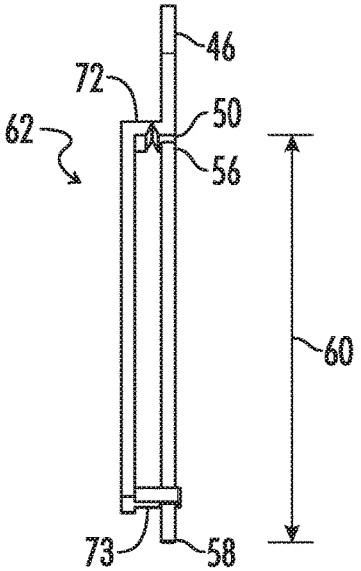
FIG. 6 illustrates a right side elevation view of the skewer of the skewer system of FIG. 1.
Figure 7:
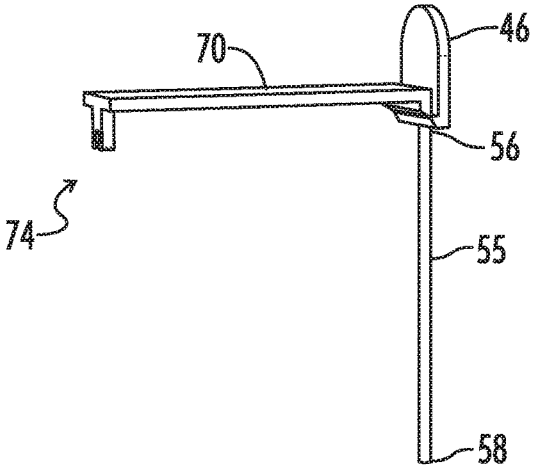
FIG. 7 illustrates a right side elevation view of the skewer of FIG. 6.

The front tab 62 may be configured to pivot between a locked position, as shown in FIGS. 1-6 and 9, in which the front tab 62 is oriented generally parallel to the vertical shaft height 60 and the stack height 20 and an unlocked position, shown in FIGS. 7 and 10-13, in which the front tab 62 is oriented not parallel to the shaft height 60 and the stack height 20. For example, in the unlocked position, the front tab 62 may be oriented between about 10 and 180 degrees, more preferably between about 30 and 180 degrees, relative to the shaft height 60 as denoted by the angle $\alpha$ in FIG. 11. When the front tab 62 is in the locked position, the front tab 62 may have a top 64 located above (e.g., located directly above) the top 16 of the stack (as best seen in FIGS. 2-3), a bottom 66 located below (e.g., located directly below) the bottom 18 of the stack 12 (as best seen in FIG. 4), and a height 68 extending from the top 64 to the bottom 66 and generally parallel to the stack height 20. More particularly, in some embodiments, when the front tab 62 is in the locked position, the front tab 62 includes a front tab bar 70 that has a front tab bar top 86 located above the top 16 of the stack 12, a front tab bar bottom 87 located below the bottom 18 of the stack 12, a front tab bar height 88 extending from the front tab bar top 86 to the front tab bar bottom 87, the front tab bar 70 extending along the stack height 20 and confronting, preferably engaging, the front side 80 of each piece of cutlery 14 as the front tab bar 70 extends along the stack height 20. The front tab 62 may further include a top lateral extension 72 that extends from the front tab bar 70 generally perpendicular to the front tab height 68 and is located directly above the top 16 of the stack 20 (i.e., directly above the top cutlery piece) (as best seen in FIGS. 2-3), and a bottom lateral extension 73 that extends from the front tab bar 70 generally perpendicular to the front tab height 68 and is located directly below the bottom 18 of the stack 12 (i.e., directly below the bottom cutlery piece) and supports the bottom 18 of the stack 12. The bottom lateral extension 73 includes a fastener 74 configured to removably receive the vertical shaft 55 when the front tab 62 is in the locked position. Optionally, the bottom lateral extension 73 and fastener 74 are the same piece, as illustrated in FIGS. 10-13—e.g., one or more protrusions. Any suitable fastener may be used. For example, in the illustrated embodiments in FIGS. 1-9, the bottom lateral extension 73 includes a snap fit (two prongs separated by a groove that includes a channel and a hole) to receive the vertical shaft 55, which may be suitable if the vertical shaft 55 and the front tab 62 are made out of plastic for example. In another embodiment, the bottom lateral extension 73/fastener 74 fits inside a fastener hole 94 located in the vertical shaft 55 below the stack bottom 18, as illustrated in FIGS. 10-13 for example.

In the illustrated embodiment, the top lateral extension 72 is attached to the vertical shaft 55 via a first pivot axis, e.g., a living hinge 85, which again, may be advantageous if the vertical shaft 55 and the front tab 62 are plastic.

In the illustrated embodiment, as best seen in FIGS. 5, 9, 11 and 13, the top lateral extension 72 and handle tab base 50 create a wedge-shaped recess 78, which creates a weakness in the plastic (and hence a living hinge 85) directly above the wedge-shaped recess 78 that faces the top cutlery piece.

The skewer 48 may further include a handle tab 46 comprising a base 50, an apex 52, which may or may not be rounded, and a height 54 extending from the base 50 to the apex 52. Optionally, the handle tab base 50 is connected to the shaft top end 56 along a handle pivot axis 96 and further wherein the handle tab 46 is configured to pivot along the handle pivot axis 96 between a downward position, shown in FIGS. 10 and 11, in which the apex 52 is below the top 16 of the stack 12 (and the shaft top end 56) and optionally confronts the rear side 24 of the stack 12 and the handle tab height 54 is generally parallel to the stack height 20 to an upper position in which the apex 52 is above the top 16 of the stack 12 (and the shaft top end 56). Optionally, the handle tab 46 includes an aperture (not shown) for gripping.

To load the skewer system 10 in a cutlery dispenser, the system 10 is provided with the front tab 62 in the locked position and the user holds the system 10 by the handle tab 46 and the front tab 62. After loading into a dispenser, the user removes the skewer 48 by pulling the front tab 62 forwardly (i.e., toward the user) to disengage the fastener 74 from the vertical shaft 55 (e.g., the prongs of the fastener 74 move apart or the protrusion moves out of the fastener hole 94) and rotating the front tab bar 70 generally perpendicular to the stack height 20 and the vertical shaft height 60. The user then pulls the vertical shaft 55 upwardly to remove the vertical shaft 55 from the stack 12.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A skewer system for loading a stack of cutlery into a cutlery dispenser comprising:

a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side, a rear side, a width extending from the front side to the rear side and generally parallel to the stack width, an eating portion, a handle extending from the eating portion, the handle comprising a handle end and a hole extending from the cutlery piece top to the cutlery piece bottom;

b) a skewer removably attached to the stack and comprising:

i) a vertical shaft comprising a vertical shaft top, a vertical shaft bottom, and a vertical shaft height extending from the vertical shaft top to the vertical shaft bottom and generally parallel to the stack height, the vertical shaft positioned through the holes in the cutlery pieces; and ii) a front tab having a front tab top located above the top of the stack, a front tab bottom located below the bottom of the stack, and a height extending from the front tab top to the front tab bottom, the front tab configured to pivot between a locked position in which the front tab height is oriented generally parallel to the shaft height and an unlocked position in which the front tab height is not parallel to the shaft height.

2. The skewer system of claim 1, wherein, in the unlocked position, the front tab is oriented between 10 and 180 degrees relative to the shaft height.

3. The skewer system of claim 1, wherein, in the unlocked position, the front tab is oriented between 30 and 180 degrees relative to the shaft height.

4. The skewer system of claim 1 wherein the front tab, in the locked position, comprises a front tab bar comprising a front tab bar top located above the top of the stack, a front tab bar bottom located below the bottom of the stack, and a front tab bar height extending from the front tab bar top to the front tab bar bottom, the front tab bar height generally parallel to the vertical shaft height and the stack height, the front tab bar extending along the stack height and confronting the front sides of the cutlery pieces as the front tab bar extends along the stack height, a top lateral extension that extends from the front tab bar generally perpendicular to the front tab bar height and is located directly above the top of the stack, the top lateral extension comprising a rear end connected to the vertical shaft top and a forward end, and a bottom lateral extension that extends from the front tab bar generally perpendicular to the front tab bar height and is located directly below the bottom of the stack.

5. The skewer system of claim 4, wherein the bottom lateral extension further comprises a fastener configured to removably engage the vertical shaft when the front tab is in the locked position.

6. The skewer system of claim 4 wherein the top lateral extension is attached to the vertical shaft top along a first pivot axis.

7. The skewer system of claim 6 further comprising a recess located opposite the first pivot axis and facing the top of the stack.

8. The skewer system of claim 1 further comprising a handle tab comprising a base connected to the shaft top end, an apex opposite the base, and a handle tab height extending from the base to the apex.

9. The skewer system of claim 8, wherein the handle tab base is connected to the shaft top end along a handle pivot axis and further wherein the handle tab is configured to pivot along the handle pivot axis between a downward position in which the apex is below the top of the stack and confronts the rear side of the stack and the handle tab height is generally parallel to the stack height to an upper position in which the apex is above the top of the stack.

* * * * *